United States Patent [19]

Noe

[11] 4,175,595

[45] Nov. 27, 1979

[54] GASOLINE FLOW CONTROL DEVICE AND METHOD FOR USING SAME

[76] Inventor: Frank H. Noe, 8105 Conarroe Dr., Indianapolis, Ind. 46278

[21] Appl. No.: 835,578

[22] Filed: Sep. 22, 1977

[51] Int. Cl.[2] ..... B65B 3/04; G05G 5/06

[52] U.S. Cl. ..... 141/1; 141/392; 74/526; 251/90

[58] Field of Search ..... 222/23, 43, 282, 288, 222/291, 309, 505, 529; 251/153, 101, 205, 240, 90, 284, 285; 248/188.2; 141/208, 209, 392, 1; 74/526

[56] References Cited

U.S. PATENT DOCUMENTS

| | | | |
|---|---|---|---|
| 1,915,320 | 6/1933 | Jones | 248/188.2 |
| 3,285,564 | 11/1966 | Mansfield | 251/240 |
| 3,492,876 | 2/1970 | Bull et al. | 222/309 |
| 3,603,359 | 9/1971 | Belue | 141/209 |

FOREIGN PATENT DOCUMENTS

| | | | |
|---|---|---|---|
| 667947 | 8/1963 | Canada | 141/209 |

*Primary Examiner*—Stanley H. Tollberg
*Assistant Examiner*—H. Grant Skaggs
*Attorney, Agent, or Firm*—Woodard, Weikart, Emhardt & Naughton

[57] ABSTRACT

A gasoline flow control device for regulating the flow of gasoline through a gasoline pump handle comprising a body having an upper and a lower spaced-apart surface thereon, the upper surface having a plurality of steps therein varying in distance from the lower surface on the body. Each step on the upper surface is concave in configuration and the lower surface includes a plurality of ridges and valleys cut therein forming an irregular surface thereon. The method of using the control device includes the steps of first moving the trigger on a gasoline pump handle a sufficient amount to begin the flow of gasoline therethrough and then wedging the body between the moved trigger and trigger guard on the handle with the lower surface gripping the trigger guard and the trigger itself resting against one of the steps on the upper surface thereof. To guarantee the suitability of the control device for use on the great majority of gasoline pump handles presently in existence, the distance from the lower surface to the most distant step on the upper surface should be about three inches with the other steps being sequentially closer to the lower surface in order to provide for differing rates of gasoline flow.

5 Claims, 3 Drawing Figures

GASOLINE FLOW CONTROL DEVICE AND METHOD FOR USING SAME

BACKGROUND OF THE INVENTION

1. Field of the Invention

This invention relates to the field of gasoline pump devices and particularly to those devices for regulating the flow of gasoline through a pump and handle arrangement.

2. Description of the Prior Art

Since shortly after the invention of the automobile, it has been quite common to transfer gasoline from a bulk tank to an automobile tank through a lengthy hose having a handle and nozzle structure at one end. In this regard, gasoline or service stations are scattered throughout the country and it is quite common to have several such gasoline pump and handle arrangements at each station in order to transfer the gasoline to the awaiting automobiles.

It has also long been known to mount various devices on the pump handle to enable the attendant to independently set and regulate the flow of gasoline through the pump handle while he attends to his other various duties, such as checking the various fluid levels, checking the air in the tires and washing the windshield and other windows on the automobile. Examples of such control devices or attachments are disclosed in the following references.

| Pat. No. | Patentee | Issue Date |
|---|---|---|
| 3,285,564 | Mansfield | 11/15/66 |
| 3,165,239 | West | 1/12/65 |
| 2,545,820 | Lehr | 3/20/51 |
| 2,577,255 | Logan | 12/04/51 |

Specifically, Mansfield shows a novel structure with an insert shown generally at 58 in FIG. 5 for adjusting the position of the lever to regulate the gas flow. West, on the oher hand, describes a nozzle for use with coin-operated gasoline dispensers, such structure being attached to the nozzle to prevent someone holding the nozzle valve open when the operator's hand is removed from the trigger. Lehr and Lofan et al. disclose more complex control assemblies, the one in Logan et al. involving a valve stop which may be manually moved about the axis of the valve-actuating stem between one of two positions of angular adjustment. Lehr discloses a quick setting rate flow nozzle that permits the gasoline to flow at a reduced rate thus enabling the attendant to place the nozzle in the tank opening and leave it while he performs other services in connection with the car.

With the ever-increasing number of self-service gasoline stations around the country, the individual customer has become more aware of the problems attendant with filling the tank with gas while also trying to accomplish various other thinks concerning his automobile. In this regard, the problem is further complicated because most such self-service stations have removed any rate or flow controlling attachments previously mounted on the pump handles.

To remedy this situation, it is not uncommon, as suggested in West, for an individual customer to wedge some object, such as a piece of wood or a stone, under the control lever or trigger for the nozzle to thereby hold the nozzle valve open and continue the flow of gasoline while he attends to the other services as listed above. The problem with the usage of such objects is that they are not always readily available and are often not efficient or effective in regulating the flow of gasoline into the automobile because of their makeshift nature. In addition, such an object may get stuck or wedged in a position which may damage the handle or at least require subsequent removal by a qualified attendant.

Applicant is aware of no device or article of manufacture presently available which is addressed to the above problems.

SUMMAARY OF THE INVENTION

One embodiment of the present invention comprises a gasoline flow control device for regulating the flow of gasoline through a gasoline pump handle including a body having an upper and a lower spaced-apart surface thereon, the upper surface having a plurality of steps therein varying in distance from the lower surface on the body, and means for wedging the body between a trigger and trigger guard on a gasoline pump handle to regulate the flow of gasoline therethrough, the lower surface on the body contacting the trigger guard with the trigger resting against one of the steps on the upper surface thereon.

The above embodiment of the present invention fills an ever-growing need that has surfaced since the opening of the first self-service gasoline station. It also constitutes a significant improvement over the various odd objects which have been heretofore used by individual customers of such stations to regulate and control the flow of gasoline through the pump while they attend to various other things with regard to their automobiles. The individual need only determine the desired rate of flow and then wedge the control device of the above embodiment between the trigger and trigger guard, seating the trigger on the appropriate step to achieve such flow rate.

In one mode of practicing the above embodiment, each step is concave in configuration to better support the trigger on a gasoline pump handle and the lower surface of the body includes a plurality of ridges and valleys cut therein forming an irregular surface thereon which can better grip the trigger guard and thereby eliminate any possibility of the control device slipping or falling out while the individual is atending to other things. A number of ridges or ribs may also be provided on the opposing parallel sides of the body to better enable the customer to wedge it into position. The distance between the lower surface of the body and the most distant step on the upper surface in this mode is about three inches thereby making sure that the device will be suitable for use in the great majority of standard and existing pump handles.

A second embodiment of the present invention comprises a method for regulating the flow of gasoline through a gasoline pump handle comprising the steps of first moving the trigger on the gasoline pump a sufficient amount to begin the flow of gasoline therethrough and then wedging the control device of the above embodiment between the moved trigger and trigger guard with the trigger resting against one of the steps on the upper surface thereof corresponding to the desired rate of flow.

One object of the present invention is to provide a new and improved gasoline flow control device for regulating the flow of gasoline through a gasoline pump handle thereby enabling the individual to attend to other concerns with his automobile while his tank fills with gasoline.

Another object of the present invention is to provide a new and improved gasoline flow control device and a method for using the same at self-service gasoline stations enabling the customer to regulate the flow of gasoline into his automobile's tank while he attends to other services related to his automobile.

Related objects and advantages of the present invention will be apparent from the following description.

DESCRIPTION OF THE PREFERRED EMBODIMENT

Figure 1:
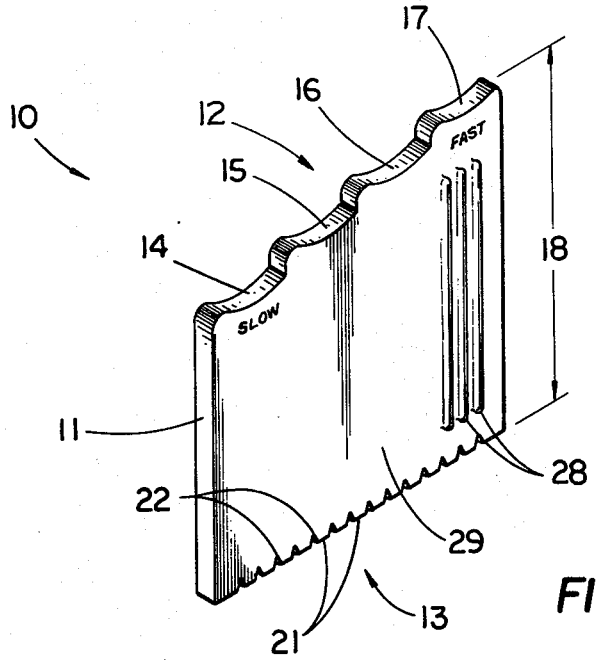
FIG. 1 is a perspective view of the gasoline flow control device comprising the preferred embodiment of the present invention.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relatres.

Referring now to FIG. 1, the gasoline flow control device 10 comprising the preferred embodiment of the present invention is therein depicted. Device 10 consists of a main body or frame 11 that has an upper or first surface 12 and an opposing lower or second surface 13 which are spaced apart and form the contact surfaces with the trigger and trigger guard on a gasoline pump handle, as further discussed hereinbelow.

Upper surface 12 includes four steps 14–17 of increasing distance from lower surface 13 against which the trigger may rest when the control device is wedged into position. The rate of flow of gasoline, of course, varies according to which step is used, with the most distant step 17 from lower surface 13 providing the fastest flow of gasoline through the pump handle whereas the closest step 14 results in the minimum flow rate thereby allowing more time for the individual customer to perform other operations concerning his automobile. In this regard, it is possible as shown on preferred device 10 to secure legends such as "slow" and "fast" adjacent the appropriate steps on the upper surface 12 as an initial instruction and later reminder to the individual of the respective flow rates associated with each step.

The exact numer of steps and their distance from lower surface 13 can, of course, vary greatly according to many factors, the major concern being to construct a control device with increased versatility in order that it may be used with the great majority of existing gasoline pump handles. In the preferred embodiment, four such steps are used to provide an ample range of flow rates. In addition, distance 18 between the lower surface 13 and the most distant step 17 on upper surface 12 is about three inches thereby providing a very versatile control device.

A possible modification to the control device of the present invention, as shown in preferred device 10 in FIG. 1, is to construct each step 14–17 with a concave surface. The benefit in such an alteration is that the great majority of triggers or levers on existing gasoline pump handles have convex lower surfaces which will then rest more firmly against the particular step to lessen any chance of the device 10 slipping or becoming unwedged between the trigger and trigger guard. A second possible modification as also shown in device 10 of the preferred embodiment is to provide a numer of ridges 21 and valleys 22 on the lower surface 13 thereby forming an irregular surface. The benefit of this modification is also associated with the gripping action of the given device when wedged into position during use. The great majority of trigger guards on existing gasoline pump handles are U-shaped in cross section and lower surface 13 can better seat against the trigger guard and prevent any unwanted slipping with the various ridges and valleys 21 and 22 cut therein.

Figure 2:
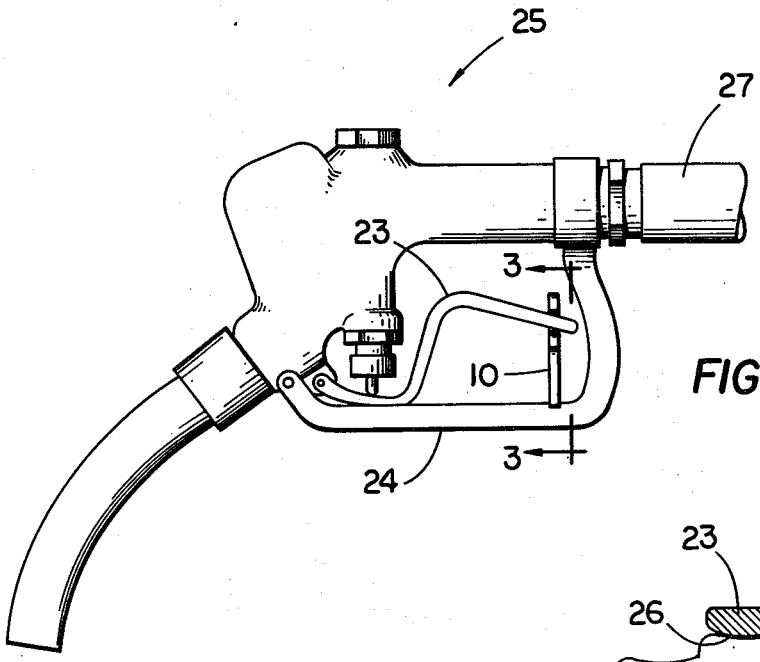
FIG. 2 is a reduced side view of a conventional gasoline pump handle with the control device of FIG. 1 wedged between the trigger and trigger guard to regulate the flow of gasoline therethrough without manual exertion.
Figure 3:
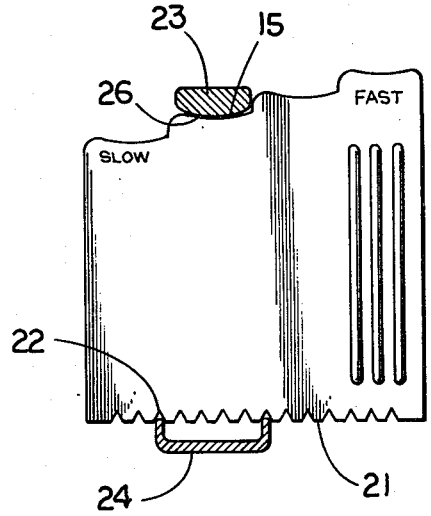
FIG. 3 is a reduced part-sectional view of the gasoline pump handle and control device in FIG. 2 taken along line 3—3.

Referring now to FIGS. 2 and 3, the preferred control device 10 is shown therein wedged between the trigger or lever 23 and the trigger or lever guard 24 on a conventional or standard type of gasoline pump handle 25. As better shown in FIG. 3, the convex lower surface 26 of trigger 23 is seated firmly against concave step 15 and the ridges and valleys 21 and 22 on lower surface 13 form a solid support and contact with the U-shaped cross-sectional configuration of trigger guard 24. Positioned as shown, the flow of gasoline through handle 25 would be regulated at a moderate rate of speed thereby allowing the individual to attend to other various concerns relating to his automobile while his tank is filled with gas without the requirement of any continuing manual exertion on his part.

The preferred method of using control device 10 of the preferred embodiment involves first moving or actuating trigger 23 a sufficient amount to begin the flow of gasoline responsive thereto through the hose 27 and handle 25. Then, with the gasoline flowing at the desired rate, control device 10 is wedged between the trigger and trigger guard 23 and 24, respectively, to thereby regulate and maintain the flow of gasoline at the desired rate. Lower surface 13 on device 10 contacts and grips the trigger guard 24 and the trigger 23 rests and seats against one of the steps on upper surface 12.

Another possible modification of the control device of the present invention, as also incorporated into device 10 of the preferred embodiment, involves placing several ridges or ribs 28 on the opposing parallel sides 29 of body 11 which connect the upper and lower surfaces thereon. These ridges or ribs provide a gripping surface to better enable the individual to wedge the device between the trigger and trigger guard.

The material composition and exact shape or configuration of the control device 10 of the present invention can, of course, vary greatly according to many factors, including such things as availability, ease of construction and individual cost and preference. In this regard, body 11 could be easily constructed using any conventional methods from wood, hard rubber, or any metal sufficiently strong to support the trigger on a gasoline pump handle when wedged into position. However, body 11 of the preferred control device 10 of the present invention was molded from a thermoplastic material providing the strength and support characteristics required for its proposed use.

Although not shown in the preferred embodiment, another possible modification to the control device of the present invention would be to attach or mount a magnet (not shown) to one of the opposing sides 29 of body 11. Since the device is intended to be kept at all times in the automobile, the magnet would provide a means of securing device 10 in a particular position such as in the glove compartment, on the underside of the dashboard, or in the compartment adjacent the gas cap in order that the individual will be aware at all times of the location of the device in case he needs to fill up his tank with gasoline.

While the invention has been illustrated and described in detal in the drawings and foregoing description, the same is to be considered as illustrative and not restrictive in character, it being understood that only the preferred embodiments have been shown and described and that all changes and modifications that come within the spirit of the invention are desired to be protected.

I claim:

1. A gasoline flow control device for regulating the flow of gasoline through a gasoline pump handle, comprising:

(a) a body having an upper and a lower spaced-apart surface thereon, the upper surface having a plurality of concave steps therein varying in distance from the lower surface of said body, the lower surface on said body including a plurality of ridges and valleys cut therein to better grip the trigger guard on a gasoline pump handle; and (b) means for positioning said body between a trigger and a trigger guard on a gasoline pump handle to regulate the flow of gasoline therethrough, the ridged lower surface on said body contacting the trigger guard with the trigger resting against one of the concave steps on the upper surface thereof.

2. The control device in claim 1 in which said body includes opposing parallel sides connecting the upper and lower surfaces thereon, said means for positioning including a plurality of ribs on the opposing parallel sides for gripping said body and positioning it between the trigger and trigger guard on a gasoline pump handle.

3. The control device of claim 2 in which the distance from the lower surface on said body to the most distant step on the upper surface thereon is about three inches.

4. A metod for regulating the flow of gasoline through a gasoline pump handle, comprising the steps of:

(a) moving the trigger on a gasoline pump handle a sufficient amount to begin the flow of gasoline therethrough; and (b) positioning a control device between the moved trigger and trigger guard on the gasoline pump handle to regulate the flow of gasoline therethrough, a lower surface on the positioned device including a plurality of ridges and valleys cut therein to grip the trigger guard with the trigger resting against one of a plurality of concave steps in an upper surface thereon.

5. The method of claim 4 in which said positioning includes gripping a plurality of ribs on opposing parallel sides of the control device for easier positioning between the trigger and trigger guard on the gasoline pump handle.

* * * * *